US005516377A

United States Patent [19]

Highsmith et al.

[11] Patent Number: 5,516,377

[45] Date of Patent: May 14, 1996

[54] GAS GENERATING COMPOSITIONS BASED ON SALTS OF 5-NITRAMINOTETRAZOLE

[75] Inventors: Thomas K. Highsmith, North Ogden; Gary K. Lund, Ogden; Reed J. Blau, Richmond; Jerald C. Hinshaw; Daniel W. Doll, both of Ogden, all of Utah

[73] Assignee: Thiokol Corporation, Ogden, Utah

[21] Appl. No.: 179,736

[22] Filed: Jan. 10, 1994

[51] Int. Cl.[6] ..... C06B 45/06; C06B 25/34; C06B 31/12

[52] U.S. Cl. ..... 149/18; 149/92; 149/36; 149/19.1; 149/62; 149/109.2

[58] Field of Search ..... 149/46, 47, 55, 149/56, 62, 78, 92, 99, 105, 106, 36, 19.1, 109.2, 18

[56] References Cited

U.S. PATENT DOCUMENTS

| | | | |
|---|---|---|---|
| 3,348,985 | 10/1967 | Stadler et al. | 149/2 |
| 3,468,730 | 9/1969 | Gawlick et al. | 149/61 |
| 3,719,604 | 3/1973 | Prior et al. | 252/186 |
| 3,739,574 | 6/1973 | Godfrey | 60/39.03 |
| 3,778,084 | 12/1973 | Sutherland et al. | 280/150 AB |
| 3,898,112 | 8/1975 | Strecker et al. | 149/92 |
| 3,909,322 | 9/1975 | Chang et al. | 149/36 |
| 3,940,298 | 2/1976 | Beckert et al. | 149/92 |
| 4,142,029 | 2/1979 | Illy | 521/95 |
| 4,358,327 | 11/1982 | Reed, Jr. et al. | 149/88 |
| 4,608,102 | 8/1986 | Krampen et al. | 149/92 |
| 4,909,549 | 3/1990 | Poole et al. | 280/738 |
| 4,948,439 | 8/1990 | Poole et al. | 149/46 |
| 5,035,757 | 7/1991 | Poole | 149/46 |
| 5,084,118 | 1/1992 | Poole | 149/22 |
| 5,139,588 | 8/1992 | Poole | 149/61 |
| 5,197,758 | 3/1993 | Lund et al. | 149/61 |

FOREIGN PATENT DOCUMENTS

0519485A1 12/1992 European Pat. Off. ..... C06D 5/60

OTHER PUBLICATIONS

E. Lieber, et al., The Reaction of Nitrous Acid with Nitroaminoguanidine, J. Am Chem. Soc., 73:2327–2331 (1951).

E. Lieber, et al., The Ultraviolet Absorption Sepctra of 5–Nitroaminotetrazole and its Salts, J. Am. Chem. Soc. 73: 2329–31 (1951).

R. Stollé et al., [Guanyl–amino]–5–tetrazol (XV), Zur Kenntnis des Amino–5–tetrazols, (1929) p. 1126.

M. B. Frankel, et al. Derivatives of Dicyanamide, Jo. Org. Chem., 28:2428 (1963).

E. Lieber, et al, The Comparative Acidic Properties of Some 5–Substituted Tetrazoles, J. Am Chem. Soc. vol. 73:1792–95 (1951).

J. S. Mihina et al, The Reaction of Nitriles with Hydrazoic Acid: Synthesis of Monosubstituted Tetrazoles, J. Chem Soc. 1082 (1951).

M. Kuhn und R. Mecke, IR–Spektroskopische Untersuchungen am Dicyan–amid–Anions, Chem. Ber. 94:3010, (1961).

M. Kuhn et al. Diskussion der Zuordnung, Skraup, Binder, [Guanyl–amino]–5–tetrazol (XV), Stolle: Zur Kenntnis des Amino–5–telrazols, Jahrg, 62, pp. 1126–1127. (1958).

W. L. Burdick, Some Ammono–Carbonic Acids and Their Reactions in Liquid Ammonia, Am J. Chem. Soc., 47:1485–90 (1925).

Chiang, George C., Triazines and Other 6–Membered Rings, Chemical Abstracts, 113: 231414f (1990).

A. Nakamura et al, Preparation of Calcium Dicyanamide Aqueous Solution as a Pharmecutical Starting Material, Chemical Abstracts, 109:148873b (1988).

A. Nakamura et al. A Process for the Preparation of Dicyanamide Metal Salts as Intermediates for Antimicrobials, Chemical Abstracts, 109: 210568m (1988).

W. P. Norris and R. A. Henry, "Cyanoguanyl Azide Chemistry," pp. 650–660, Mar. 1964.

R. N. Butler, "Tetrazoles," *Comprehensive Heterocyclic Chem.*, Chpt. 4.13, pp. 791–838. (1978).

*Primary Examiner*—Gary E. Hollinden
*Assistant Examiner*—Joseph D. Anthony
*Attorney, Agent, or Firm*—Ronald L. Lyons; Madson & Metcalf

[57] ABSTRACT

A composition is provided which has at least one salt of 5-nitraminotetrazole and an at least one oxidizer selected from among inorganic nitrates, inorganic nitrites, metal oxides, metal peroxides, organic peroxides, inorganic perchlorates, inorganic chlorates, metal hydroxides, and mixtures thereof. The compositions are useful in the gas generant field.

18 Claims, No Drawings

GAS GENERATING COMPOSITIONS BASED ON SALTS OF 5-NITRAMINOTETRAZOLE

FIELD OF THE INVENTION

The present invention relates to pyrotechnic compositions, and particularly to non-azide-fueled gas generant compositions.

BACKGROUND OF THE INVENTION

Gas generating chemical compositions are useful in a number of different contexts. One important use for such compositions is in the operation of "air bags." Air bags are gaining in acceptance to the point that many, if not most, new automobiles are equipped with such devices. Indeed, many new automobiles are equipped with multiple air bags to protect the driver and passengers.

In the context of automobile air bags, sufficient gas must be generated to inflate the device within a fraction of a second. Between the time the car is impacted in an accident, and the time the driver would otherwise be thrust against the steering wheel, the air bag must fully inflate. As a consequence, nearly instantaneous gas generation is required.

Commercial procurement requirements place stringent limits on the types of gaseous combustion products, such as limits on CO and $NO_x$, and specify that the gas be generated at a sufficiently and reasonably low temperature so that the occupants of the car are not burned upon impacting a just inflated air bag. Accordingly, it is necessary that the combination of the gas generant and the construction of the air bag isolates automobile occupants from excessive heat. All of this is required while the gas generant maintains an adequate burn rate. In the industry, burn rates in excess of 0.5 inch per second (ips) at 1,000 psi, and preferably in the range of from about 1.0 ips to about 1.2 ips at 1,000 psi are generally desired.

Another related but important design criteria is that the gas generant composition produces a limited quantity of particulate materials. Particulate materials can interfere with the operation of the supplemental restraint system, present an inhalation hazard, irritate the skin and eyes, or constitute a hazardous solid waste that must be dealt with after the operation of the safety device.

In addition to producing limited, if any, quantities of particulates, it is desired that at least the bulk of any such particulates be easily filterable. For instance, it is desirable that the composition produce a filterable, solid slag. If the solid reaction products form a stable material, the solids can be filtered and prevented from escaping into the surrounding environment. This also limits interference with the gas generating apparatus and the spreading of potentially harmful dust in the vicinity of the spent air bag which can cause lung, mucous membrane and eye irritation to vehicle occupants and rescuers.

At present, sodium azide is the most widely used and accepted gas generating material. Sodium azide nominally meets industry specifications and guidelines. Nevertheless, sodium azide presents a number of persistent problems. Sodium azide is relatively toxic as a starting material, since its toxicity level as measured by oral rat $LD_{50}$ is in the range of 45 mg/kg. Workers who regularly handle sodium azide have experienced various health problems such as severe headaches, shortness of breath, convulsions, and other symptoms.

In addition, sodium azide combustion products can also be toxic since molybdenum disulfide and sulfur are presently the preferred oxidizers for use with sodium azide. The reaction of these materials produces toxic hydrogen sulfide gas, corrosive sodium oxide, sodium sulfide, and sodium hydroxide powder. Rescue workers and automobile occupants have complained about both the hydrogen sulfide gas and the corrosive powder produced by the operation of sodium azide-based gas generants.

Increasing problems are also anticipated in relation to disposal of unused gas-inflated supplemental restraint systems, e.g. automobile air bags, in demolished cars. The sodium azide remaining in such supplemental restraint systems can leach out of the demolished car to become a water pollutant or toxic waste. Indeed, some have expressed concern that sodium azide, when contacted with battery acids following disposal, forms explosive heavy metal azides or hydrazoic acid.

The significant disadvantages of sodium azide fueled compositions have prompted intensive efforts to develop an economically attractive replacement. As a consequence, a considerable number of alternative gas generant compositions have been proposed. However, most of these proffered replacements fail to solve the problems associated with the conventional gas generant or create additional problems.

It would, therefore, be a significant advancement in the art to provide a composition which is capable of generating large quantities of gas that would be a direct drop-in replacement and would overcome the known disadvantages associated with the sodium azide gas generants.

Such compositions and methods for their use are disclosed and claimed herein.

SUMMARY AND OBJECTS OF THE INVENTION

The present invention provides a composition which is capable of generating gaseous combustion products at a sufficiently rapid rate to be considered as an alternative to sodium azide fueled gas generants.

A composition of the present invention can be formulated to generate non-toxic and non-caustic combustion products, and limited, if any, solid particulates.

A composition according to the present invention can be characterized as comprising at least one organic or inorganic salt of 5-nitraminotetrazole in combination with at least one oxidizer selected from the group consisting of inorganic nitrites, inorganic nitrates, metal oxides, metal or organic peroxides, inorganic perchlorates, inorganic chlorates, metal hydroxides, and mixtures thereof.

DETAILED DESCRIPTION OF THE INVENTION

A composition according to the present invention comprises a fuel effective amount of at least one salt of 5-nitraminotetrazole and an oxidizing effective amount of at least one oxidizer. In general, the combustible fuel species is present in an amount of about 20 to about 80% by weight, and the oxidizer is present in an amount of about 20 to about 60% by weight.

The salt of 5-nitraminotetrazole can contain an organic or inorganic cation. Non-metallic cations can be selected, for instance, from among organic cations and, in principle, cations of non-carbon heterocycles such as borazines. Thus, the cation can be a non-metallic cation of a high nitrogen-content base. Exemplary non-metallic cations include, among others, ammonium, hydrazinium, guanidinium, aminoguanidinium, diaminoguanidinium, triaminoguanidinium, biguanidinium, aminotriazolium, guanizinium, aminotetrazolium, hydrazino tetrazolium, 5-guanylaminotetrazolium, diaminofurazanium, diaminotriazolium, and azoamino bis(aminofurazan).

Furazan compounds and oxidation products thereof are disclosed in *J. O. C. U.S.S.R.* 756 (1981), the complete disclosure of which is hereby incorporated herein by reference.

Inorganic cations include, for instance, ammonium, a metal from Group Ia, Ib, IIa, IIb, IIIa, IVb, VIb, VIIb or VIII of the Periodic Table (Merck Index (9th Edition 1976)), or complex metal ammines. The fuel of the present invention can also comprise a complex of 5-nitraminotetrazole. The salts and complexes include those of transition metals such as copper, cobalt, iron titanium and/or zinc; alkali metals such as potassium and sodium; alkaline earth metals such as strontium, magnesium, and calcium; boron; and aluminum. Of these, salts having an ammonium, potassium, and/or zinc cation are presently preferred.

In the present invention, inorganic oxidizing agents are preferred because they can produce a lower flame temperature and can provide an improved filterable slag. Oxidizers include metal oxides, metal hydroxides, inorganic nitrates, inorganic nitrites, inorganic chlorates, inorganic perchlorates, metal or organic peroxides, and the like. Exemplary organic peroxides include, for instance, di-t-butyl peroxide, t-butyl hydroperoxide, benzoyl peroxide, or a peracids such as peracetic acid. Exemplary metal peroxides include alkaline earth metal peroxides (Ca, Ba, Sr, or Mg) and, for instance, transition metal peroxides. Persulfates can also be used such as sodium persulfate. Metal oxides or hydroxides include for instance, the oxides and hydroxides of bismuth, copper, cobalt, chromium, iron, manganese, molybdenum, and tungsten, such as CuO, $MnO_2$, $Co_2O_3$, $Co_3O_4$, $Fe_2O_3$, $MoO_3$, $Bi_2MoO_6$, $Bi_2O_3$, $Bi(OH)_3$, and $Cu(OH)_2$. The oxidizer can be an inorganic nitrate or nitrite such as lead nitrate, tin nitrate, $NH_4NO_3$, $NH_4NO_2$, $KClO_4$, $KNO_3$, $K_2Cr_2O_7$, or $Sr(NO_3)_2$. Complex metal nitrite and nitrate anions may also be used, of which $Co(NO_2)_6$, $Cu(NO_2)_4$, and $Zn(NO_2)4$ are illustrative. The oxidizers can be present in the form of mixtures. For instance, conventional oxidizers such as $Sr(NO_3)_2$, $NH_4ClO_4$, $NH_4NO_3$, $KClO_3$, $KClO_4$, and $KNO_3$, can be included in admixture with another oxidizer for a particular application, such as to provide increased flame temperature or to modify the gas product yields.

The primary fuel can, if desired, be combined with a secondary fuel or tertiary fuel. Illustrative of the suitable secondary and tertiary fuels are dicyanamide salts, metal bi-tetrazole salts, complexes or salts of aminotetrazole, tetrazoles, triazoles, ureas, guanidines, nitramine, nitroguanidine and other high nitrogen content compounds, as well as a compound known as "BTA", complexes, salts or derivatives thereof. BTA and other tetrazoles are described in co-pending application no. 08/101,396 filed Aug. 2, 1993, and in co-pending application 08/162,596, filed Dec. 3, 1993. By preference, high nitrogen content means more than 60 percent by weight nitrogen. Inorganic dicyanamide salts can be prepared by adapting the procedures disclosed in Japan (Kokai) 62-288102 (Dec. 15, 1987), Japan (Kokai) 62-288113 (Dec. 15, 1987), U.S. Pat. No. 4,933,450, *J. O. C.*, 28:2428 (1963), and Kuhn et al., IR-Spektroskopishe Untersuchungen am Dicyan-amid-anions, *Chem. Ber.*, 94:3010 (1961), the complete disclosures of which are incorporated herein by reference. Dicyanamide salts of alkali or alkaline earth metals are useful herein. Examples of metal cations of inorganic dicyanamide salts are,for instance, Al, Ba, Bi, Ca, Co, Cr, Cu, Fe, K, Mg, Mn, Mo, Na, W, Ti, or Zn. Other suitable cations include such cations mentioned elsewhere herein such as, for instance, ammonium, hydrazinium, guanidinium and the like. The secondary, tertiary fuels can be added in varying combinations.

Nitraminotetrazole and derivatives thereof can be prepared by adapting the procedures disclosed in *J. Am. Chem. Soc.*, 73:2327 (1951), and *J. O. C. U.S.S.R.* 412 (1981) the complete disclosures of which are incorporated herein by reference.

Salts of 5-nitraminotetrazole can be prepared directly or indirectly. Indirect syntheses are simple, and can proceed from the ammonium salt of 5-nitraminotetrazole. For instance, the ammonium salt can be prepared by treating 5-aminotetrazole with nitric acid in the presence of sulfuric acid, and subsequently neutralizing the mixture with $NH_4OH$. For instance, metal salts can be obtained by treating the ammonium salt of 5-nitraminotetrazole with a reagent containing the desired metal cation species under reaction conditions suited for the selected reagent.

Shaped charges, such as pellets, of the present composition can exhibit satisfactory crush strengths.

Certain embodiments of the present compositions can serve as gas generants in the automotive field and can be combusted to give good gas yields of acceptable gas products. Several of the compositions have a high flame temperature and are useful for heating a secondary gas, such as in a hybrid gas generant system. Other compositions have a low flame temperature and are useful for directly generating gas such as in a supplemental safety restraint system, an air bag, used in automobiles and like vehicles. Solids produced during combustion do not suffer problems noted earlier with respect to sodium azide.

In the automotive applications, such as in supplemental passenger or driver restraint systems, it may be desired to formulate a composition wherein the fuel, the oxidizer or both the fuel and oxidizer do not contain alkali metal cations.

Illustrative compositions from which attractive gas generating formulations can be made include, for instance, zinc nitraminotetrazole, strontium nitrate, sodium dicyanamide, and, optionally, copper(II) oxide; zinc nitraminotetrazole, strontium nitrate and a binder such as lactose; ammonium nitraminotetrazole, ammonium nitrate, and, if desired, at least one co-oxidizer such as strontium nitrate or cobalt(II) nitrate hexahydrate, and, optionally, a burn rate catalyst such as fumed alumina; zinc nitraminotetrazole, ammonium nitrate, strontium nitrate, and zinc bis-(5-aminotetrazole); ammonium nitraminotetrazole, copper(II) oxide; zinc nitraminotetrazole and copper(II) oxide, and a secondary fuel such as, for instance, potassium bitetrazole; and zinc nitraminotetrazole, potassium bitetrazole, and strontium nitrate to list but a few.

A method for generating gas comprises igniting the composition according to the present invention.

The present invention also contemplates a vehicle having an inflatable restraining device, such as an automobile air bag system, which comprises a collapsed, inflatable air bag, a means for generating gas connected to that air bag for inflating the air bag wherein the gas generating means includes an igniter and also contains a nontoxic gas generating composition which comprises a fuel and an oxidizer therefore wherein the fuel comprises a composition according to the present invention. Suitable means for generating gas include gas generating devices which are used in supplemental safety restraint systems used in the automotive industry. The supplemental safety restraint system may, if desired, include conventional screen packs to remove particulates, if any, formed while the gas generant is combusted.

The compositions of the present invention are easily ignited with conventional igniters. Igniters using materials such as boron/potassium nitrate are usable with the compositions of the present invention.

The compositions of the present invention are readily adapted for use with hybrid air bag inflator technology. Hybrid inflator technology is based on heating a stored inert gas (argon or helium) to a desired temperature by burning a small amount of propellant. Hybrid inflators do not require cooling filters used with pyrotechnic inflators to cool combustion gases, because hybrid inflators are able to provide a lower temperature gas. The gas discharge temperature can be selectively changed by adjusting the ratio of inert gas weight to propellant weight. The higher the gas weight to propellant weight ratio, the cooler the gas discharge temperature for a given propellent formulation.

Therefore, the present invention also contemplates a vehicle having a hybrid gas generating system which comprises a pressure tank having a rupturable opening, a predetermined amount of inert gas disposed within that pressure tank; a gas generating device for producing hot combustion gases and having means for rupturing the rupturable opening; and means for igniting the gas generating composition. The tank has a rupturable opening which can be broken by a piston when the gas generating device is ignited. The gas generating device is configured and positioned relative to the pressure tank so that hot combustion gases are mixed with and heat the inert gas. Suitable inert gases include, among others, argon, and helium and mixtures thereof. The mixed and heated gases exit the pressure tank through the opening and ultimately exit the hybrid inflator and deploy an inflatable bag or balloon, such as an automobile air bag. The gas generating device contains a composition according to the present invention.

The present invention is described further in the following non-limiting examples.

EXAMPLES

In the Examples, a satisfactory burn rate (for air bag applications), unless otherwise indicated, means a burn rate at about 1000 psi of at least 0.500 ips.

Unless otherwise stated in the Examples, the zinc nitraminotetrazole means the dihydrate.

Example 1

To a vessel in an ice bath (40° C.) was added sulfuric acid (300 ml), to the sulfuric acid was added 5-aminotetrazole (127.5 grams). The reaction mixture was cooled to about 20° C. To the cooled mixture were added $HNO_3$ (90%, 120 ml) dropwise while maintaining the temperature in the range of 20°–25° C. using an ice bath. After addition of $HNO_3$, the ice bath was removed, and the mixture was stirred for 15 minutes. Onto ice (3 kg) were poured the stirred mixture, and to the iced mixture were added $NH_4OH$ (25%) to obtain a pH of 5. After cooling overnight at 0° to 5° C. the material was filtered, washed, and sucked dry, and dried under mild vacuum overnight to collect ammonium nitraminotetrazole.

Example 2

To ammonium nitraminotetrazole (25 grams) was added $ZnCl_2$ (17.1 grams) and a white precipitate was obtained. After the solution and precipitate were cooled in an ice bath, both were filtered, and the filtrate was collected. The filtrate was washed with ethanol to collect zinc nitraminotetrazole (29.8 grams).

Example 3

Zinc nitraminotetrazole was obtained in a manner analogous to Example 2 using, zinc acetate or zinc nitrate hydrate instead of $ZnCl_2$.

Example 3

To a stirred and heated vessel containing 5-nitraminotetrazole (3.0 grams) in water (60 ml) were added $Co(NO_3)_2 \cdot 6H_2O$ (1.94 grams) in water (40 ml) whereupon a yellow orange solution was obtained. Stirring was continued without further heating. To the solution were added methanol (100 ml) and ethanol (100 ml) to obtain a precipitate. After redissolution and followed by cooling overnight, a mixed precipitate which included a pale orange precipitate was obtained. After reheating, redissolution and solvent precipitating by addition of ethanol, pale orange crystals of cobalt nitraminotetrazole were obtained.

Example 5

An iron complex of 5-nitraminotetrazole was obtained in a manner analogous to Example 4 by using $Fe(NO_3)_3 \cdot 9H_2O$ (10.9 grams) instead of $Co(NO_3)_2 \cdot 6H_2O$.

Example 6

Zinc nitraminotetrazole (3.32 grams) strontium nitrate (4.75 grams), and sodium dicyanamide (1.93 grams) were mixed, slurried in water, dried under mild vacuum at about 150° F., and pressed into pellets, and the pellets were combusted. The burn rate was satisfactory.

Example 7

In the same manner as in Example 6, pellets were pressed from a composition of zinc nitraminotetrazole (2.23 grams), strontium nitrate (2.36 grams), sodium dicyanamide (1.41 grams), and CuO (0.40 grams). The pellets were combusted and had an average burn rate of 1.073 ips at 1000 psi.

Example 8

In a manner analogous to Example 6, pellets were prepared from a composition of strontium nitrate (2.07 grams), zinc nitraminotetrazole (7.93 grams), and combusted. The burn rate was 0.77 ips at 1119 psi. The theoretical flame temperature is 2,498° K.

Example 9

In a manner analogous to Example 6, pellets were prepared from a composition of strontium nitrate (2.72 grams), zinc nitraminotetrazole (6.98 grams), and lactose (0.30 grams), and combusted. The burn rate was 0.89 ips at 1119 psi. The theoretical flame temperature is 2,478° K.

Example 10

Pellets were prepared in a manner analogous to Example 6 from a composition of ammonium nitraminotetrazole (5.06 grams), strontium nitrate (2.19 grams), and ammonium nitrate (2.75 grams), and combusted.

Example 11

In a manner analogous to Example 6, pellets were made from a composition of zinc bis-(aminotetrazole) (21.16 grams), ammonium nitrate (58.04 grams), zinc nitraminotetrazole dihydrate (20.78 grams). The pellets were combusted, and the burn rate was 0.813 ips at 1000 psi.

Example 12

In a manner analogous to Example 6, pellets were made from a composition of ammonium nitraminotetrazole (29.08 grams) and strontium nitrate (20.92 grams), and combusted. The burn rate was 0.313 ips at 1000 psi.

Example 13

Pellets were made from a composition of zinc nitraminotetrazole dihydrate (25.69 grams), potassium bitetrazole (23.99 grams) and strontium nitrate (28.42 grams), and combusted. The burn rate was 2.096 ips at 1000 psi. This composition has a theoretical flame temperature of 2,456° K.

Example 14

Pellets were made from a composition of zinc nitraminotetrazole (29%), copper(II) oxide (50%), and potassium bitetrazole (21%). The pellets were combusted and the burn rate was 0.606 ips at 1000 psi. The theoretical flame temperature is 1,887° K.

Example 15

To water (150 ml) was added ammonium nitraminotetrazole (20.0 grams) while heating. To the heated mixture was added methanol (300 ml) whereafter KOH (15.24 grams) in methanol was added while stirring and warming the mixture. $NH_3$ was evolved. The mixture was stirred for two hours, while sparging with nitrogen, at a temperature of about 30° C. To the sparged mixture was added methanol (200 ml), and the mixture was cooled in an ice bath. The cooled mixture was then filtered, washed, and dried under mild vacuum to obtain potassium nitraminotetrazole (circa 28 grams).

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What we claim is:

1. A gas generant composition comprising a fuel effective amount of at least one metal salt of 5-nitraminotetrazole and an oxidizing effective amount of at least one oxidizer selected from the group consisting of metal oxides, metal peroxides, metal hydroxides, and mixture thereof, wherein combustion of said composition produces a gas useful for inflating automobile air bags and a solid slag.

2. A composition according to claim 1, wherein the salt of 5-nitraminotetrazole contains a cation of a metal from Group Ia, IIa, IIb, IIIa, IVb, VIb, VIIb or VIII of the Periodic Table (Merck Index (9th Edition 1976)).

3. A composition according to claim 1, wherein said salt of 5-nitraminotetrazole contains a complex metal ammine cation.

4. A composition according to claim 1, wherein said oxidizer is selected from the group consisting of CuO, $Co_2O_3$, $Fe_2O_3$, $MoO_3$, $Bi_2MoO_6$, $Bi_2O_3$, $Cu(OH)_2$, and mixtures thereof.

5. A composition according to claim 1, wherein said composition contains about 20 to about 80% by weight of fuel.

6. A composition according to claim 1, wherein said composition contains about 20 to about 80% by weight of fuel, and said salt of 5-nitraminotetrazole contains a cation of a metal from Group Ia, Ib, IIa, IIb, IIIa, IVb, VIb, VIIb or VIII of the Period Table (Merck Index (9th Edition 1976)), a secondary oxidizer, and a binder.

7. A composition according to claim 1, wherein the salt of 5-nitraminotetrazole has a cation selected from the group consisting of cobalt and zinc.

8. A composition according to claim 7, wherein said oxidizer is a metal oxide or hydroxide of a metal selected from the group consisting of bismuth, copper, cobalt, chromium, iron, manganese, molybdenum, and tungsten.

9. A composition according to claim 1, wherein the oxidizer does not contain a cation of a metal from Group I-A of the Periodic Table.

10. A composition according to claim 9, wherein said salt of 5-nitraminotetrazole does not contain a cation of an alkali metal.

11. A composition according to claim 1, wherein said composition includes a secondary fuel.

12. A composition according to claim 11, wherein said secondary fuel is selected from the group consisting of a metal dicyanamide, a metal bitetrazole, tetrazoles, aminotetrazoles, triazoles, salts and complexes thereof, and mixtures thereof.

13. A composition according to claim 11, wherein the secondary fuel is an alkali metal dicyanamide or an alkaline earth metal dicyanamide.

14. A composition according to claim 11, wherein secondary fuel is a transition metal dicyanamide.

15. A gas generant composition consisting essentially of:

a fuel effective amount of at least one metal salt of 5-nitraminotetrazole, wherein the metal is selected from the group consisting of metals of Group Ia, Ib, IIa, IIb, IIIa, IVb, VIb, VIIb or VIII of the Period Table (Merck Index (9th Edition 1976));

an oxidizing effective amount of an oxidizer selected from the group consisting of metal oxides, metal peroxides, metal hydroxides, and mixtures thereof;

a secondary oxidizer;

a secondary fuel selected from the group consisting of a metal dicyanamide, a metal bitetrazole, tetrazoles, aminotetrazoles, triazoles, salts and complexes thereof, and mixtures thereof; and a binder, wherein combustion of said composition produces a gas useful for inflating automobile air bags and a solid slag.

16. A gas generant composition according to claim 15, wherein the metal salt of 5-nitraminotetrazole has a cation selected from the group consisting of cobalt and zinc.

17. A gas generant composition according to claim 15, wherein the oxidizer is a metal oxide or hydroxide of a metal selected from the group consisting of bismuth, copper, cobalt, chromium, iron, manganese, molybdenum, and tungsten.

18. A gas generant composition according to claim 15, wherein the oxidizer is selected from the group consisting of CuO, $Co_2O_3$, $Fe_2O_3$, $MoO_3$, $Bi_2O_3$, $Cu(OH)_2$, and mixtures thereof.

* * * * *